US006662402B2

(12) United States Patent
Giddings et al.

(10) Patent No.: US 6,662,402 B2
(45) Date of Patent: Dec. 16, 2003

(54) APPARATUS FOR CLEANING FABRICS, FLOOR COVERINGS, AND BARE FLOOR SURFACES UTILIZING A SOIL TRANSFER CLEANING MEDIUM

(75) Inventors: Daniel G. Giddings, Holland, MI (US); Richard W. Wellens, Plymouth, MN (US); Larry D. Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 37 days.

(21) Appl. No.: 10/081,374

(22) Filed: Feb. 22, 2002

(65) Prior Publication Data

US 2002/0194692 A1 Dec. 26, 2002

Related U.S. Application Data

(60) Provisional application No. 60/299,561, filed on Jun. 20, 2001.

(51) Int. Cl.[7] ..... A47L 11/292

(52) U.S. Cl. ..... 15/320; 15/383; 15/384

(58) Field of Search ..... 15/320, 322, 383, 15/384

(56) References Cited

U.S. PATENT DOCUMENTS

| | | | | |
|---|---|---|---|---|
| 990,775 | A | 4/1911 | Reid | 15/52 |
| 1,268,963 | A | 6/1918 | Gray | 15/320 |
| 2,518,183 | A | 8/1950 | Renne | 15/52 |
| 3,631,558 | A | 1/1972 | Kovacevic | 15/50.3 |
| 3,696,458 | A | 10/1972 | Leifheit et al. | 15/50.3 |
| 3,750,217 | A | 8/1973 | Liebscher | 15/50.3 |
| 3,761,985 | A | 10/1973 | Leifheit | 15/50.3 |
| 3,843,989 | A | 10/1974 | DeMaagd | 15/50.3 |
| 3,875,605 | A | 4/1975 | Fegan | 15/50.3 |
| 3,936,199 | A | 2/1976 | Zimmermann | 401/40 |
| 3,983,592 | A | 10/1976 | Fegan | 15/49.1 |
| 4,245,371 | A | 1/1981 | Satterfield | 15/320 |
| 4,360,946 | A | 11/1982 | Marshall, Jr. et al. | 15/321 |
| 4,369,544 | A | 1/1983 | Parisi | 15/320 |
| 4,433,451 | A | 2/1984 | Parisi | 15/321 |
| 4,570,278 | A | 2/1986 | Bloome et al. | 15/97 |
| 4,654,916 | A | 4/1987 | Postonen et al. | 15/50.3 |
| 4,845,794 | A | 7/1989 | Korski et al. | 15/51 |
| 4,884,310 | A | 12/1989 | Knestele | 15/3 |
| 4,914,773 | A | 4/1990 | Ham | 15/3 |
| 5,086,539 | A | 2/1992 | Rench | 15/384 |
| 5,203,047 | A | 4/1993 | Lynn | 15/99 |
| 5,241,724 | A | 9/1993 | Lim | 15/322 |

(List continued on next page.)

FOREIGN PATENT DOCUMENTS

| | | |
|---|---|---|
| DE | 6934247 | 8/1969 |
| DE | 3616398 | 12/1986 |
| DE | 4117957 | 12/1992 |
| DE | 10020197 | 11/2001 |
| EP | 0286328 | 10/1988 |
| JP | 05123278 | 5/1993 |
| WO | 9749324 | 12/1997 |

*Primary Examiner*—Theresa T. Snider
(74) *Attorney, Agent, or Firm*—Fulbright & Jaworski L.L.P.

(57) ABSTRACT

An apparatus and method for cleaning fabrics, floor coverings, and bare floor surfaces utilizing a soil transfer cleaning medium is disclosed. A method of mechanically removing soil from a surface intended to be cleaned includes the steps of successively and repeatedly: wetting a portion of a cleaning medium with a cleaning liquid; extracting any soil and at least some of the cleaning liquid from the previously wetted portion of the cleaning medium; and wiping the surface intended to be cleaned with the portion of the cleaning medium so as to transfer soil from the surface intended to be cleaned to the cleaning medium. Portable and vehicle-based devices may be utilized to practice the method of cleaning.

19 Claims, 7 Drawing Sheets

U.S. PATENT DOCUMENTS

| | | | | |
|---|---|---|---|---|
| 5,287,581 | A | 2/1994 | Lo | 15/52 |
| 5,309,597 | A | 5/1994 | Wymore | 15/22.3 |
| 5,371,912 | A | 12/1994 | Hall | 15/98 |
| 5,404,609 | A | 4/1995 | Rench et al. | 15/52.1 |
| 5,465,456 | A | 11/1995 | Fellhauer et al. | 15/320 |
| 5,483,718 | A | 1/1996 | Blehert et al. | 15/50.3 |
| 5,515,568 | A | 5/1996 | Larson et al. | 15/50.3 |
| 5,657,504 | A | 8/1997 | Khoury | 15/98 |
| 5,697,119 | A | 12/1997 | Mussalo | 15/320 |
| 5,699,576 | A | 12/1997 | Sohaiby | 15/103 |
| 5,715,565 | A * | 2/1998 | Kern | 15/322 |
| 5,797,163 | A | 8/1998 | Whitaker et al. | 15/413 |
| 5,813,086 | A | 9/1998 | Ueno et al. | 15/320 |
| 5,901,410 | A | 5/1999 | Windmeisser | 15/354 |
| 5,933,900 | A | 8/1999 | Wang | 15/50.3 |
| 6,030,465 | A | 2/2000 | Marcussen et al. | 134/6 |
| 6,055,699 | A | 5/2000 | Cho | 15/321 |
| 6,088,873 | A | 7/2000 | Pacchini et al. | 15/320 |
| 6,145,145 | A | 11/2000 | Besel | 15/22.3 |
| 2003/0033681 | A1 | 2/2003 | Blum et al. | 15/104.002 |

* cited by examiner

APPARATUS FOR CLEANING FABRICS, FLOOR COVERINGS, AND BARE FLOOR SURFACES UTILIZING A SOIL TRANSFER CLEANING MEDIUM

CROSS REFERENCE TO RELATED APPLICATIONS

This application hereby incorporates by reference and, under 35 U.S.C. §119(e), claims the benefit of priority of U.S. Provisional Patent Application Ser. No. 60/299,561 filed Jun. 20, 2001.

FIELD OF THE INVENTION

The present invention relates generally to surface maintenance or conditioning machines, and more particularly to those machines employing one or more surface maintenance or conditioning appliances or tools to perform a floor cleaning task.

BACKGROUND OF THE INVENTION

In general, proper carpet maintenance involves regular vacuuming and periodic cleaning to remove soil by methods such as hot water extraction, shampooing, bonnet cleaning, foam cleaning, etc. Some of the soil is loosely found between carpet fibers while other soil is held upon the carpet fibers by some means such as electrostatic forces, van der Waals forces, or oil bonding. Still other soil is mechanically trapped by carpet fibers. Regular vacuuming is essential as it removes some of the loose soil that damages the fibers. Vacuuming maintains the surface appearance of a carpet and keeps the level of soil in the pile at an acceptable level. Vacuuming removes only particulate soil and some unbound or loosely bound surface dirt; therefore, other methods of cleaning are periodically required to improve the appearance of the carpet. Wet cleaning methods are better for removing oils, greases, bound dirt, and other forms of matter that cause soiling on carpet. These methods are often used by professional cleaners and trained personnel.

One type of surface maintenance machine for carpet cleaning is referred to as a bonnet cleaner. Bonnet cleaners employ an absorbent bonnet or pad (hereinafter referred to as the "pad") attached to a rotary driver for rotating the pad about an axis generally perpendicular to the carpet surface. Cleaning liquid is sprayed directly onto the carpet followed by the rotating pad used to agitate the carpet and transfer soil from the carpet onto the bonnet, i.e., the pad. Since the pad is commonly two-sided, the pad may be reversed once one side of the pad gets soiled to a selected level. The pad may be periodically replaced and later cleaned depending upon the application and wear characteristics of the pad.

The soil transfer process of the bonnet cleaners may be characterized as a "circular engagement process" since the pad rotates relative to the carpet surface. The method employed by bonnet cleaners does have the advantage of being fast drying if a relatively small amount of cleaning liquid is employed. However, limitations of bonnet cleaners include transferring soil from soiled areas to a relatively cleaner area, leaving much of the cleaning fluid in the carpet, and having the potential to damage the carpet. With respect to the latter, some carpets, particular twisted ply variations, may be damaged by aggressive engagement with the rotating pad. Additionally, the bonnet cleaning process is a relatively labor intensive process since the pad requires frequent soil monitoring and frequent removal of soiled pads.

Yet another limitation of bonnet cleaners is the relatively uncontrolled use of cleaning liquid in the carpet cleaning process as some areas of the carpet may receive more cleaning liquid spray than other areas. Reliance on operator spraying of cleaning liquid to the carpet surface may result in overwetting of some areas and underwetting of other areas.

Another type of surface maintenance machine intended for carpet cleaning is referred to as an "extractor machine." Extractor machines are commonly used for deep carpet cleaning. In general, an extractor is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Generally, in the extraction process a relatively large quantity of cleaning liquid is applied on the carpet. While the vacuum system recovers a portion of the applied cleaning liquid, a significant portion is retained by the carpet. As a consequence, carpet drying times are substantially longer than in the bonnet cleaning process. Excessive carpet wetting may promote the growth of fungus and/or bacteria within the carpet. Additionally, carpet overwetting may also cause surface stains to appear or reappear as underlying soil or stains migrate from the bottom of the carpet to its surface. Additionally, extractors are generally limited to a single operational direction as the steps of wetting, agitation, and vacuuming are sequentially performed. As a result, extractor machines may be difficult to maneuver in some environments, i.e., complex floor layouts.

SUMMARY AND OBJECTS OF THE INVENTION

An object of the present invention is the provision of a carpet cleaning machine promoting efficient use of cleaning liquid in carpet cleaning.

Another object of the present invention is to enhance cleaning area per unit of cleaning solution.

Another object of the present invention is to provide a cleaning method that permits a carpet to dry more rapidly.

Yet another object of the present invention is to provide a carpet cleaning process that has the ability to lift carpet pile which exposes more of the carpet fibers to the surrounding drying air so as to permit the carpet to dry more rapidly than if the pile was not lifted.

Yet another object of the present invention is the provision of a cleaning process and apparatus for cleaning a variety of surfaces, including but not limited to floor surfaces, stairways, walls, and upholstered furniture or other fabric surfaces.

The present invention is directed both to a method of cleaning surfaces and an apparatus for performing the method. In a broad sense, the cleaning process is similar to a damp cloth wiping operation wherein soil from a surface is transferred to the damp cloth. More particularly, the cleaning process utilizes:

In accordance with the present invention, a revolving cleaning medium, which after being wiped against a surface intended to be cleaned is wetted, followed immediately by the step of extracting so as to remove cleaning solution and any soil from the cleaning medium, and again wiped against the surface—the process revolving or repeating. In a preferred operation, one portion of the cleaning medium is wetted with cleaning liquid, while another portion is being extracted to remove soil and cleaning liquid therefrom, and while yet another portion is being wiped against the surface to transfer soil from the surface to the cleaning medium. The process continues in a revolving or cyclical manner so that each portion of the cleaning medium is sequentially wetted, extracted, and wiped against the surface.

The method of cleaning surfaces in accordance with the present invention includes the steps of (i) wetting a revolving cleaning medium with a cleaning solution, (ii) followed by removing at least some of the cleaning liquid from the revolving cleaning medium directly after wetting by way of a moisture extraction device, and (iii) wiping the surface with the revolving cleaning medium so as to transfer soil from the surface to the revolving cleaning medium and subsequently removing transferred soil from the revolving cleaning medium.

In accordance with present invention, a transportable device is utilized to perform the cleaning process on a carpeted surface. The device may be a relatively portable machine having a cleaning liquid tank, a soiled solution recovery tank, a vacuum system, and cleaning head. The cleaning head may include a revolving cleaning medium and associated drive mechanism. A vacuum extractor may be used to engage the cleaning medium to remove soil and at least some of the cleaning liquid from the cleaning medium.

In accordance with one embodiment of the invention the revolving cleaning medium is configured as a pair of counter rotating cylindrical cleaning media having portions of each successively wetted, extracted, and wiped against a surface intended to be cleaned, with the process repeating or revolving.

DETAILED DESCRIPTION OF THE INVENTION

The present invention is directed both to a method of cleaning surfaces and an apparatus for performing the method. In a broad sense as will subsequently be described, the cleaning process in accordance with the present invention is similar to a damp cloth wiping operation wherein soil from a surface is transferred to the damp cloth.

More particularly, the cleaning process in accordance with the present invention utilizes a revolving cleaning medium which after being wiped against a surface intended to be cleaned is wetted, followed immediately by the step of extracting so as to remove cleaning liquid, in part, and any soil from the cleaning medium, and again wiped against the surface—the process revolving or repeating.

In a preferred operation, one portion of the cleaning medium is wetted with cleaning liquid, while another portion is being extracted to remove soil and cleaning liquid therefrom, and while yet another portion is being wiped against the surface to transfer soil from the surface to the cleaning medium. The process continues in a revolving or cyclical manner so that each portion of the cleaning medium is sequentially wetted, extracted, and wiped against the surface.

Figure 1:
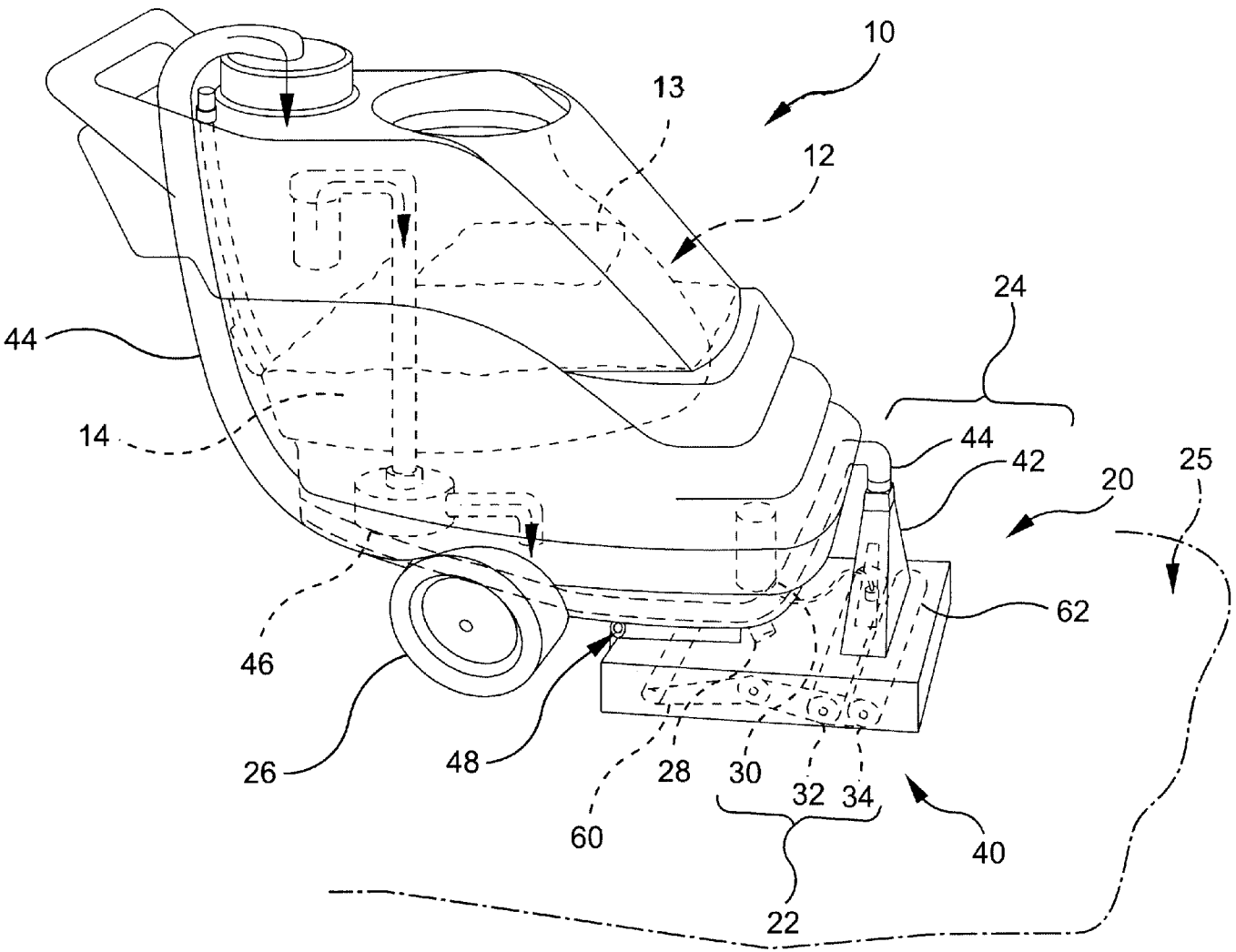
FIG. 1 is a perspective illustration of one embodiment of a cleaning machine according to the present invention.

FIG. 1 illustrates an embodiment of a transportable floor surface cleaning machine 10 according to the present invention. More particularly, machine 10, for illustrative purposes, is illustrated as an AC powered (with power cord not shown) walk-behind carpet extractor similar to those known in the art, including a cleaning solution tank 12 for containing a cleaning liquid 13, such as a mixture of water and a cleaning chemical, a recovery tank 14, a cleaning head 20, a cleaning liquid dispenser 22, and a soiled solution extraction system 24 as further described herein. In operation, machine 10 is supported upon the ground surface 25 by rear wheels 26 and caster wheel 28. Representative examples of walk-behind carpet extractors having cleaning solution tank 12, recovery tank 14, cleaning liquid dispenser 22, and soiled solution vacuum extraction system 24 include models 1230 and 1260 extractors manufactured by Tennant Company, Minneapolis, Minn. In an illustrated embodiment, cleaning head 20 in accordance with the present invention may be used in conjunction with one of such known walk-behind extractor machines and the like.

Figure 2:
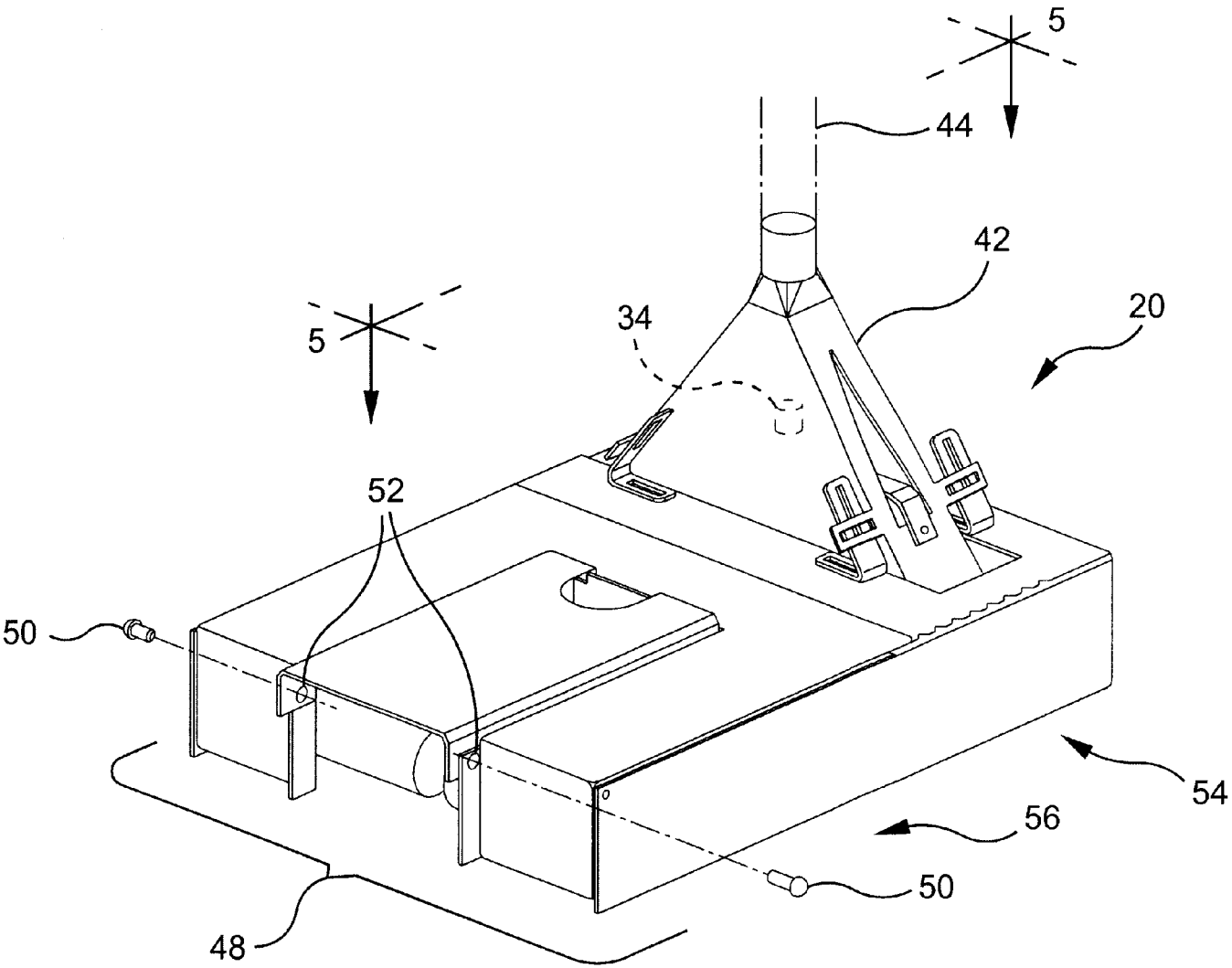
FIG. 2 is a perspective view of a cleaning head of the cleaning machine of FIG. 1.
Figure 3:
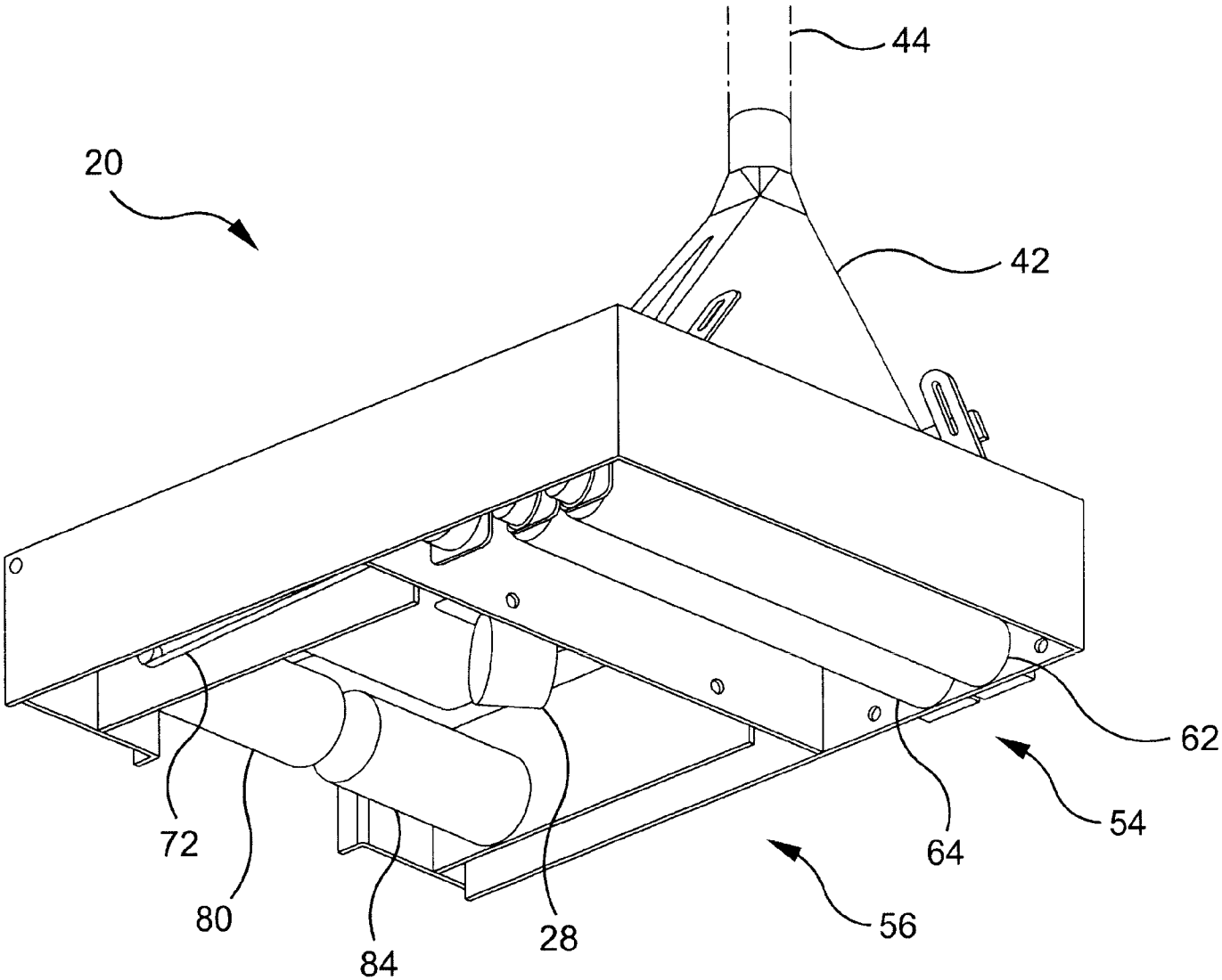
FIG. 3 is another perspective view of the cleaning head of FIG. 1.
Figure 4:
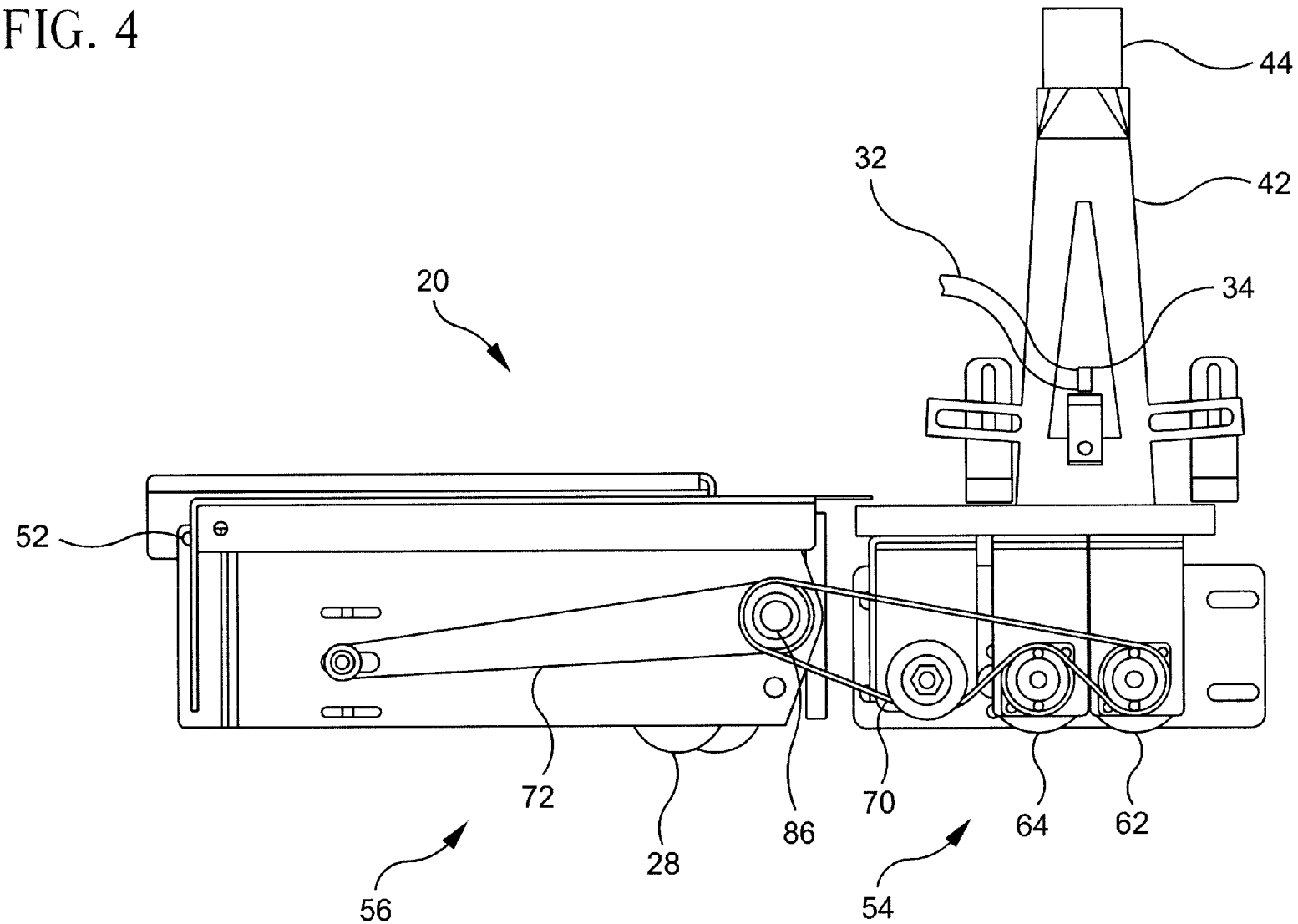
FIG. 4 is a side elevation view of the cleaning head of FIG. 1.

Cleaning head 20, in accordance with the present invention, includes a cleaning medium 40 and associated drive assembly 60 as is more particularly shown in detail in FIGS. 2 and 3. Drive assembly 60 selectively revolves cleaning medium 40 relative to cleaning head 20 and surface 25. In operation, cleaning medium 40 is intended to be first wetted with cleaning liquid 13 by cleaning liquid dispenser 22 and immediately followed by a moisture extraction process before being wiped against surface 25 so as to transfer soil from surface 25 to cleaning medium 40. In the extraction process, soil, as well cleaning solution resulting from the step of wetting the cleaning medium just performed, is removed from cleaning medium 40 by soiled solution extraction system 24. As further explained herein, cleaning medium 40 revolves during operation so that different portions of the cleaning medium 40 are simultaneously being wetted with cleaning liquid 13, extracted by extraction system 24, or wiped against the surface 25.

Referring to FIGS. 1 through 3, cleaning head 20 is attached at a forward portion of the machine 10 via a coupling structure 48. Coupling structure 48 includes a pair of fasteners 50 engaging apertures 52 in cleaning head 20 and permitting cleaning head 20 to pivot or rotate about an axis (not shown) passing through apertures 52. Cleaning head 20 may include one or more assemblies which are movably connected together so that the assemblies may move relative to each other so as to facilitate operational contact of the cleaning head 20 across undulating floor surfaces. In the illustrated embodiment, cleaning head includes forward and rear assemblies 54, 56, respectively. Forward assembly 54 includes cleaning medium 40 in the form of a pair of counter rotating cylindrical cleaning pads and/or brushes 62 and 64, and vacuum extractor 42. Rear assembly 56 includes cleaning medium drive assembly 60, coupling structure 48, and caster wheel 28. Caster wheel 28 is coupled to cleaning head 20 to support at least a portion of machine 10 on surface 25.

As described above, cleaning medium 40 functions to transfer soil from surface 25 to the cleaning medium 40. For a carpet surface, cleaning medium 40 functions to wipe the carpet and transfer soil from carpet fibers to the cleaning medium 40. A variety of different materials may be utilized as a cleaning medium, including but not limited to fabrics and absorbent foams, i.e., being "foam rubber" like. Cleaning medium 40 in one embodiment of the invention as illustrated in the Figures includes a pair of cylindrical devices, i.e., cylindrical cleaning pads and/or brushes 62 and 64, hereafter referred to as simply brushes. However, it should be noted herein that cylindrical brushes 62 and 64, i.e. the cleaning medium 40, may be a constructed from any combination of pad-like or bristle-like or foam-like materials, and the like, which serve to transfer soil from the surface intended to be cleaned unto the cleaning medium.

An exemplary construction of brushes 62 and 64 includes a substrate, such as a woven synthetic fabric, having pile fibers tufted thereinto. In one embodiment of the invention, the substrate has an appearance and feel that is similar to the surface fabric used on a commonpaint roller. In some instances, it may be desirable to intersperse stiffer fibers, i.e., brush like bristles, into the substrate to enhance the agitation action of cleaning medium 40.

Figure 5:
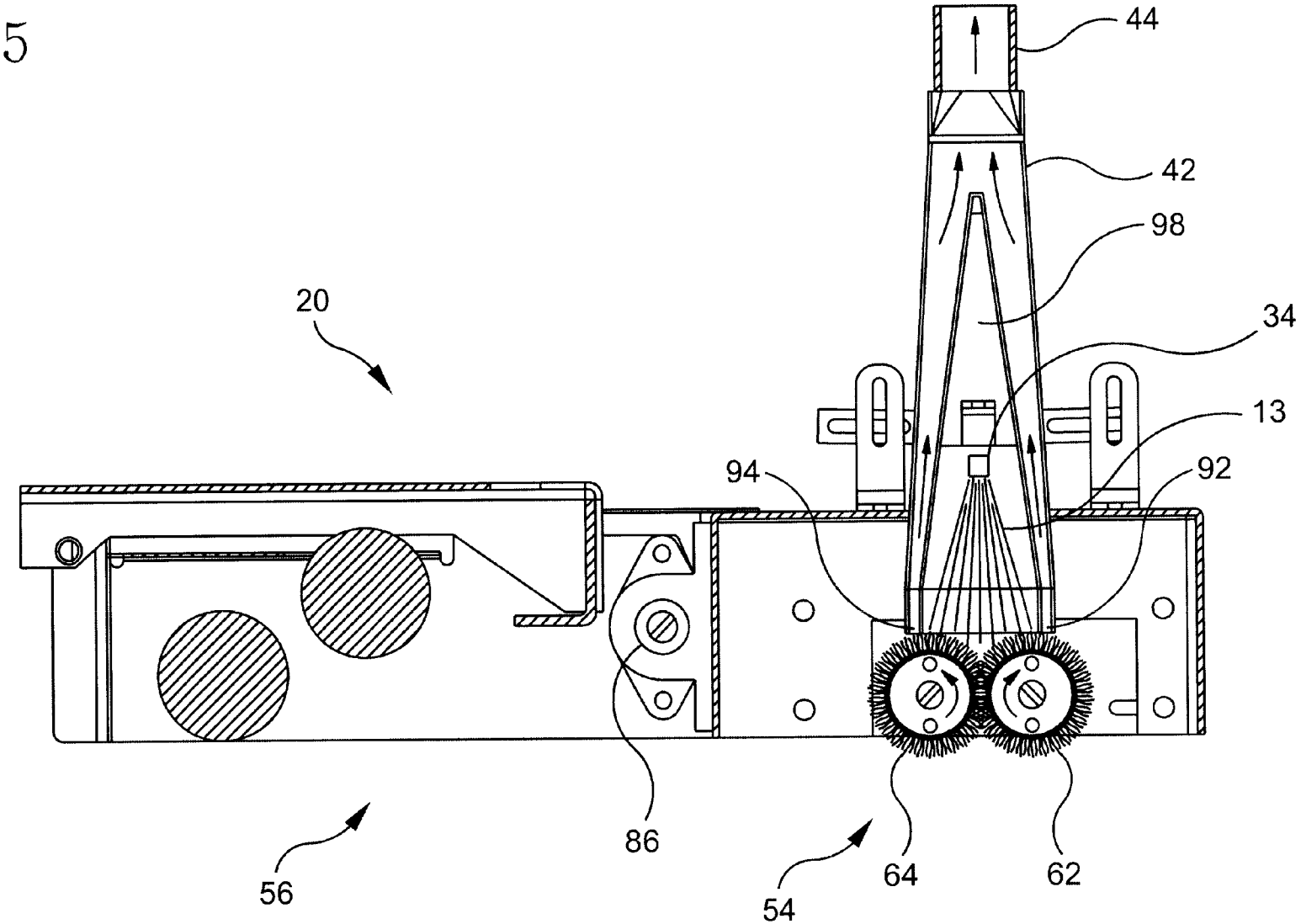
FIG. 5 is a cross sectional view of the cleaning head of FIG. 2, taken along lines 5—5.
Figure 6:
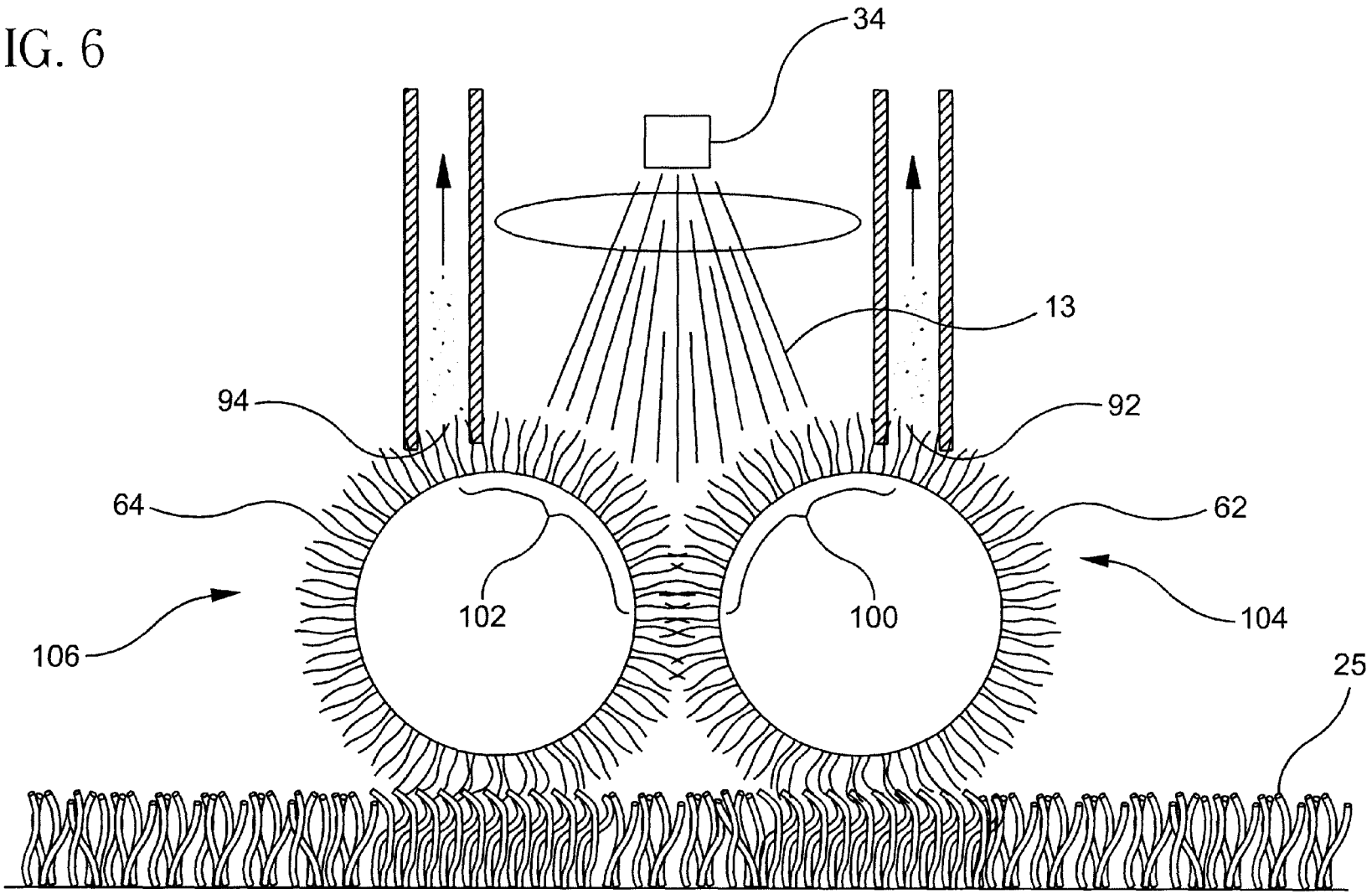
FIG. 6 is a detailed side elevational view of a portion of the cleaning head of FIG. 5.
Figure 7:
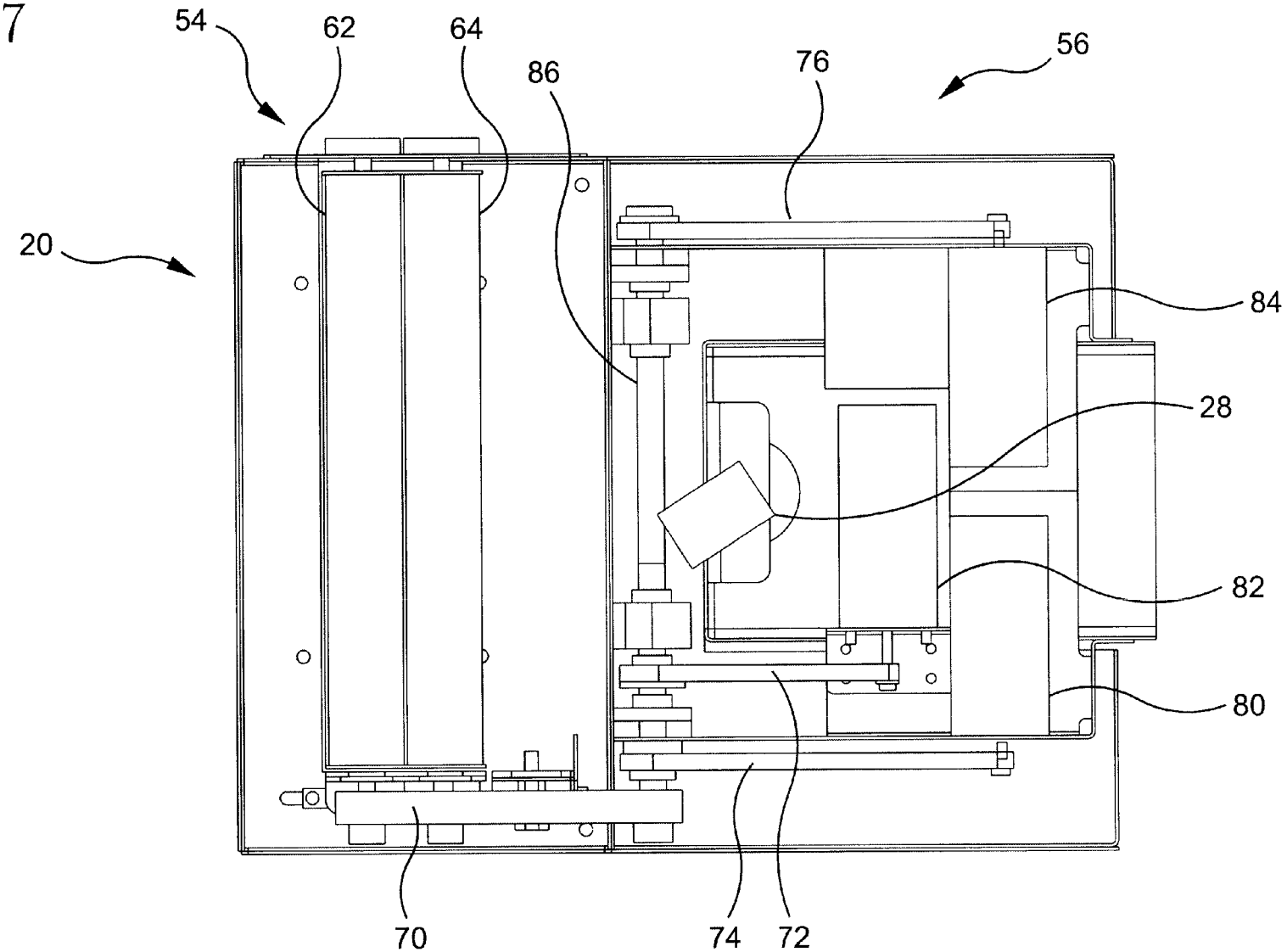
FIG. 7 is bottom plan view of the cleaning head of FIG. 1.

With particular reference to FIGS. 4 through 7, brushes 62, 64 of cleaning medium 40 are rotatably driven by cleaning medium drive assembly 60. Drive assembly 60 includes drive belts 70, 72, 74, 76 and electric motors 80, 82, 84. Drive belt 70 is coupled to a common rotating jackshaft 86 which is driven by three small electric motors 80, 82, 84. Each motor 80, 82, 84 has an associated drive belt 72, 74, 76 to the jackshaft 86. In alternative embodiments, a single electric motor may be utilized to rotatably drive cylindrical brushes 62 and 64. As depicted in FIGS. 5 and 6, cleaning medium brushes 62, 64 are rotated in opposite directions during operation. To facilitate cleaning head 20 contact with floor surface 25 during operation, front and rear assemblies 54, 56 are pivotally coupled about jackshaft 86.

In an exemplary embodiment of the invention, cleaning dispenser 22 includes a pump 30, shown fixed to the main assembly of machine 10—see FIG. 1, for pumping cleaning liquid 13 through conduit 32 and nozzle 34 thereby delivering cleaning liquid 13 to brushes 62, 64. Appropriate fluid controls, such as switches, valves, etc. (not shown) are provided to control the application of cleaning fluid 13. As depicted in FIGS. 5 and 6, nozzle 34 spray is substantially directed to the cleaning medium brushes 62, 64, and not surface 25. Alternative dispensing means may include drip bars or tubes (not shown) for transferring cleaning liquid 13 to cleaning medium 40.

As indicated earlier, extraction system 24 is intended to remove cleaning liquid 13 and any soil from the cleaning medium 40, for example brushes 62 and 64. In the embodiment of the invention illustrated in the drawings, extraction system 24 includes a vacuum extractor 42 which engages brushes 62, 64, a vacuum conduit 44, and a vacuum fan 46 to remove soiled solution from brushes 62, 64 and to transfer soiled solution to recovery tank 14. As particularly illustrated in FIGS. 4 and 5, extractor 42 includes a bifurcated end having a pair of elongate vacuum apertures 92, 94 in operational contact with associated cleaning medium brushes 62, 64. Soiled solution and airflow through elongate apertures 92, 94 is joined at an upper portion of extractor 42 for further removal through hose 44 to recovery tank 14. Elongate apertures 92, 94 are sized in relation to brushes 62, 64 to remove soiled solution across substantially the entire transverse length of the brushes. An alternative vacuum extractor may include two separate vacuum extractor heads each having separate conduits to the recovery tank. As depicted in FIG. 5, extractor 42 defines an interior region 98 in which nozzle 34 is provided. A spray of cleaning solution 13 directed toward cleaning medium 40, namely brushes 62 and 64, from nozzle 34 is intended to be generally contained within interior region 98.

In operation, machine 10 is operator-propelled across a surface. In accordance with the present invention, machine 10 may be bi-directionaly operated—i.e., machine 10 may be propelled forwardly or rearwardly during operation. To initiate a cleaning operation, appropriate controls, such as switches (not shown), are used to activate vacuum motor 46, cleaning medium drive 60 and cleaning liquid pump 30. Upon activation, brushes 62, 64 of cleaning medium 40 are revolved via drive assembly 60 and cleaning liquid 13 is dispensed through spray nozzle 34 to cleaning medium brushes 62, 64.

Wetted portions of brushes 62, 64 may be defined as those brush portions which receive cleaning liquid from the spray nozzle 34. Regarding brush 62, which rotates in a referenced clockwise manner, the wetted portion is generally that portion of brush 62 between approximately 9 o'clock and 12 o'clock. Regarding brush 64, which rotates in a referenced counterclockwise manner, the wetted portion is generally that portion of brush 64 between approximately 3 o'clock and 12 o'clock. Referring to FIG. 6, wetted portions of brushes 62, 64 are designated as numerals 100, 102. The relative dampness or wetness of wetted portions 100, 102 is of course dependent upon the quality of the spray exiting nozzle 34 and the rate of rotation of cylindrical brushed 62 and 64. For example, increased wetness of brushes 62 and 64 may be achieved by a slower rate of rotation and/or increased spray through nozzle 34.

Prior to wetted brush portions 100, 102 being rotated into contact with carpet surface 25, the relative dampness is reduced by operation of vacuum extractor 42. Vacuum extractor 42 engages each brush 62, 64 to remove some of the just deposited cleaning liquid 13 and soil previously transferred from the carpet surface. Each brush 62, 64 of the cleaning medium 40 is engaged by respective vacuum apertures 92, 94 of vacuum extractor 42 to reduce the local wetness of brushes 62, 64. As a result, rotating brushes 62, 64 have a wetted portion 100, 102 as defined above, and a reduced wetness portion 104, 106 which engages the carpet surface and transfers soil from the carpet to brushes 62, 64.

As brushes 62, 64 are revolved, reduced wetness brush portions 104, 106 engage the carpet fibers and cause soil to be transferred from the carpet fibers to brushes 62, 64. As brushes 62, 64 are further rotated, the reduced wetness portions 104, 106 (having received soil from the carpet) are sprayed with cleaning liquid through nozzle 34 and subsequently vacuum extracted through extractor 42 to convey soiled cleaning liquid from brushes 62, 64 into soiled solution recovery tank 14.

The cleaning process, in accordance with the present invention, thus includes the steps of wetting a portion of cleaning medium 40 with cleaning liquid 13, reducing the relative wetness of the wetted portion of the cleaning medium by extraction, prior to wiping the surface intended to be cleaned with the cleaning medium so as to transfer soil from the surface intended to be cleaned to the cleaning medium 40. Soil upon the cleaning medium 40 is subsequently removed as the revolving cleaning medium is rewetted and. In turn, the aforesaid cleaning process repeats as a cycle with cleaning medium 40 revolving, cleaning liquid 13 being conveyed to cleaning medium 40, extractor 42 reducing the relative wetness of a portion of the cleaning medium 40 (and removing soiled solution therefrom), and cleaning medium 40 wiping the carpet to transfer soil from the carpet to the cleaning medium 40.

Additional aspects of the present invention will be addressed. It is envisioned that the cleaning process according to the present invention may be performed on a variety of different machines, ranging from small manually operated devices, to large operator driven vehicles. The illustrated device is a walk-behind type cleaning machine, more particularly an operator propelled, generally self-contained machine. In alternative embodiments, machine 10 may include a vehicle, such as a ride-on or towed-behind vehicle, or be a hand held machine performing a cleaning operation as described herein. Machine 10 may be powered through an on-board power source, such as batteries or an IC engine.

In alternative embodiments, cleaning head 20 may be provided as an accessory or optional item for use with other cleaning machines. In other embodiments, cleaning head 20 may be utilized upon larger, operator driven machines.

Embodiments of the present invention may be utilized for cleaning a variety of floor surfaces, including but not limited to carpets, rugs, tile, vinyl, terrazzo, wood floors, and concrete surfaces. Additional surfaces which may be cleaning through a process as described herein include walls, stairways, upholstered furniture or fabric, such as curtains and the like. In a particularly preferred embodiment and as described herein with reference to machine 10 operation, the present invention is utilized for cleaning floor coverings.

Surface cleaning medium 40 may be one or more elongated cylindrical elements, as depicted in the Figures, wherein each elongated cylindrical element rotates about a generally horizontal axis of rotation generally in parallel with the surface intended to be cleaned. The axis of rotation in a particularly preferred embodiment being aligned generally transverse to the direction of intended machine 10 operation. Alternatively, cleaning medium 40 may be one or more disk-shaped elements which rotate about one or more generally vertical axes of rotation generally transverse to the surface intended to be cleaned.

Yet another embodiment of cleaning medium 40 may include a belt, with an outward belt surface being a cleaning medium, trained between two or more rollers, the belt moving as the rollers rotate. With this belt-type cleaning medium, it should be appreciated that the belt is intended to revolve so that the outward belt surface having the cleaning medium thereon sequentially passes a wetting operation, followed by an extraction process, followed by a soil transfer process—i.e., wiping the intended surface to be cleaned with cleaning medium surface of the belt. Additional embodiments of cleaning mediums are of course possible as may be appreciated by those skilled in the relevant arts.

In another embodiment cleaning medium 40 may be a cylindrical shaped element having a combination of foam and bristle surfaces. (not shown) In alternative embodiments, cleaning medium 40 may comprise a revolving belt as aforesaid. Cleaning medium 40 may include a variety of different materials including fabrics, synthetic scouring pads and foam elements and the like which serve the intended function of transferring soil from a surface being wiped onto the cleaning medium.

Extractor 42 may be provided by a wide array of structures and techniques as may be appreciated by those skilled in the relevant arts including, including but not limited to non-vacuum techniques such as pressing or squeezing, all of which are intended to be within the true spirit and scope of the present invention.

Further, although cleaning solution dispenser 22 is illustrated as being operated by a pump on the main assembly of machine 10, other arrangements are of course possible so as to achieve the intended function. As used herein, and the appended claims, the cleaning liquid may comprise any cleaning solution which assists the transfer of the soil on the surface intended to be cleaned unto the cleaning medium. For example, cleaning liquid 13 could also be in the form of a foam, vapor, liquid with suspended solids, a granular cleaning material, plain water, and the like. Of course, liquid dispenser 22 would be of different form than that as illustrated in order to accommodate the selected cleaning liquid or material. Therefore, as used herein and the appended claims, wetting of the cleaning medium encompasses, but not limited to, depositing, applying, or conveying such material onto the cleaning medium 40.

In alternative embodiments of the present invention, cleaning head 20 may be coupled to machine 10 via a plurality of pivot points, a four bar linkage, or alternative structures which facilitate head movement and cleaning medium engagement across both even and uneven floor surfaces.

Other modifications to the described embodiment may also be practicable. One or more cleaning liquid dispensing devices may be utilized in alternative embodiments of the invention. Additionally, the vacuum extractor may be alternatively configured and include a different extractor structure. For example, a plurality of vacuum extracting locations may be practicable, i.e., a first vacuum extraction location for reducing the relative dampness of the rotating cleaning medium prior to contact with the floor surface, and a second vacuum extraction location for removing soiled solution from the cleaning medium. In yet another example, a rotating belt machine may include a first cleaning liquid dispensing device, a first extraction device for reducing the dampness of the belt prior to contact with carpet, a second cleaning liquid dispensing device, and a second extraction device for removing soiled solution from the belt. As various changes could be made in the above methods and devices without departing from the scope of the invention, it is intended that all matter contained in the above description or shown in the accompanying drawings shall be interpreted as illustrative and not in a limiting sense.

Definitions are provided herein with reference to terms used in the specification and appended claims:

"Revolving": 1. Tending to revolve or happen repeatedly. 2. Available at regular intervals. As used herein, the term broadly describes a cyclical movement of the cleaning medium relative to the surface. A cylindrical shaped "revolving" cleaning medium may be rotated about an axis of rotation. A belt shaped "revolving" cleaning medium may be supported for movement about a pair or more rotating elements, e.g., rollers, etc. More complex motions or movements of the cleaning medium relative to the floor are also intended to be included within the broad definition of the term revolving, including but not limited to oscillatory and/or motions.

"Extracting": 1. Drawing or pulling out, using force or effort. 2. To remove or obtain from a substrate by mechanical action, as by mechanical pressure or vacuum. As used herein, the term broadly describes the step of removing cleaning liquid and/or soil from the cleaning medium. The step of extracting may be achieved through a mechanical shearing type operation, or a vacuum removal operation, or both.

"Wiping": 1. Engaging, contacting. As used herein, the term broadly describes physical engagement between the cleaning medium and the surface being cleaned. Each of a rotating elongated cylindrical brush, disk brush or pad when engaging a surface to be cleaned is considered to be in "wiping" contact with the surface. Wiping does not necessarily imply or suggest removing liquid from a surface. In a carpet cleaning device of the present invention, a cleaning medium being wiped against the carpet surface would transfer some amount of cleaning liquid to the carpet surface.

We claim:

1. A surface maintenance device for performing a surface cleaning process, comprising:

a revolving cleaning medium including mechanization for positioning said cleaning medium so as to wipe a surface intend d to be cleaned;

a cleaning liquid dispenser which wets a portion of the revolving cleaning medium; and an extractor in operative engagement with the revolving cleaning medium for removing some of a dispensed cleaning liquid said wetted portion prior to said portion being wiped against the surface intended to be cleaned, wherein soil from the surface intended to be cleaned is transferred to said portion of the revolving cleaning medium as said portion is wiped against the surface intended to be cleaned, said portion being subsequently rewetted and extracted so as to remove any soil previously transferred to the cleaning medium.

2. The surface maintenance device of claim 1 wherein the cleaning liquid dispenser includes a nozzle which sprays cleaning liquid onto the cleaning medium.

3. The surface maintenance device of claim 1 further comprising a soiled solution recovery tank.

4. The surface maintenance device of claim 1 wherein said extractor includes a vacuum device for removing a soiled solution of cleaning liquid and soil transferred from the surface intended to be cleaned.

5. The surface maintenance device of claim 1 wherein the cleaning medium includes at least one generally cylindrical shaped clement.

6. The surface maintenance device of claim 5 wherein the cleaning medium is a cylindrical brush.

7. The surface maintenance device of claim 5 wherein the cleaning medium includes a pair of cylindrical brushes.

8. The face maintenance device of claim 5 wherein the cleaning medium includes a pair of generally cylindrical shaped elements which are counter-rotated relative to each other.

9. The surface maintenance device of claim 8 wherein to extractor includes a pair of vacuum apertures and each one of the pair of vacuum apertures is associated with a different one of the pair of generally cylindrical shaped elements.

10. The surface maintenance device of claim 1 wherein the surface is a carpet surface, and wherein the cleaning medium engages arid deflects fiber of the carpet surface so as to wipe soil from fibers of the carpet Surface.

11. The surface maintenance device for performing a surface cleaning process, said device being capable of moving across a surface intended to be cleaned, said surface maintenance device comprising:

a pair of cleaning mediums, said cleaning mediums being counter-rotated relative to each other and contact with the surface;

a cleaning liquid dispenser which wets a portion of at least one of the cleaning mediums with a cleaning liquid; and an extractor in operative engagement with the cleaning mediums which removes some of a dispensed cleaning liquid from said portion prior to said portion being wiped against the surface intended to be cleaned, wherein soil from the surface is fared to said portion as said portion is wiped against the surface, said portion being subsequently rewetted and extracted so as to remove soil from the cleaning medium.

12. The surface cleaning machine of claim 11 wherein the cleaning liquid dispenser conveys cleaning liquid to a portion of the cleaning mediums and the extractor removes some of the cleaning liquid from the portion prior to the portion being wiped against the surface.

13. A surface maintenance machine performing a surface cleaning process, said machine comprising:

a chassis;

a revolving cleaning medium connected to the chassis;

a cleaning liquid dispenser which wets a portion of the revolving cleaning medium; and a vacuum extractor in operative engagement with the revolving cleaning medium for removing some of a dispensed cleaning liquid from said portion prior in said portion being wiped against the surface intended to be cleaned, wherein soil is transferred to the revolving cleaning medium as the cleaning medium is wiped against the surface intended to be cleaned.

14. A machine for performing a surface cleaning process, said machine comprising:

a cleaning medium and means for resolving the cleaning medium;

a cleaning liquid dispensing means for wetting a portion of the cleaning medium; and a vacuum means in operative engagement with the revolving cleaning medium for removing some of a dispensed cleaning liquid from said portion prior to said portion being wiped against the surface intended to be cleaned, wherein soil is transferred to the cleaning medium as the cleaning medium is wiped against the surface intended to be cleaned.

15. A surface maintenance machine performing a surface cleaning process, comprising:

a cleaning medium means for revolving the cleaning medium relative to a floor surface;

means for dispensing a cleaning liquid to wet a portion of the cleaning medium; and means for extracting cleaning liquid and soil from the portion of the cleaning medium prior to said portion being wiped against the floor surface, wherein soil from the floor surface is transferred to the cleaning medium.

16. A surface cleaning machine comprising:

a chassis;

a cleaning medium connected to th chassis;

a drive assembly operatively coupled to the cleaning medium;

a cleaning liquid reservoir; and an extractor, said machine capable of revolving the cleaning medium via the drive assembly, wetting a portion of the cleaning medium with cleaning liquid from the reservoir, extracting soil and at least some of the cleaning liquid from the portion of the cleaning medium via the extractor, and wiping a floor surface with the portion of the cleaning medium so as to transfer soil from the floor surface to the cleaning medium.

17. The surface cleaning machine of claim 16 wherein the extractor is a vacuum extraction assembly.

18. The surface cleaning machine of claim 16 further comprising:

a spray nozzle in fluid communication with the reservoir, said spray nozzle transferring cleaning liquid to the cleaning medium.

19. The surface cleaning machine of claim 16 wherein the cleaning medium is at least one generally cylindrical shaped element.

* * * * *

UNITED STATES PATENT AND TRADEMARK OFFICE

CERTIFICATE OF CORRECTION

PATENT NO. : 6,662,402 B2
DATED : December 16, 2003
INVENTOR(S) : Giddings, D.G. et al.

It is certified that error appears in the above-identified patent and that said Letters Patent is hereby corrected as shown below:

Column 9,
Line 6, delete “intend d” and insert -- intended --
Line 45, delete “arid” and insert -- and --
Line 46, delete “Surface” and insert -- surface --
Line 52, insert -- in -- between “and” and “contact”
Line 61, delete “fared” and insert -- transferred --

Column 10,
Line 9, delete “in” and insert -- to --
Line 16, delete “resolving” and insert -- revolving --
Line 29, insert -- and -- between “medium” and “means”
Line 39, delete “th” and insert -- the --

Signed and Sealed this

Fifth Day of April, 2005

JON W. DUDAS
*Director of the United States Patent and Trademark Office*